US005963768A

United States Patent [19]

Rhee

[11] Patent Number: 5,963,768

[45] Date of Patent: Oct. 5, 1999

[54] TONER REMIXING DEVELOPING UNIT

[75] Inventor: Chang-Soo Rhee, Suwon, Rep. of Korea

[73] Assignee: SamSung Electronics Co., Ltd., Suwon, Rep. of Korea

[21] Appl. No.: 08/967,310

[22] Filed: Oct. 21, 1997

[30] Foreign Application Priority Data

Oct. 22, 1996 [KR] Rep. of Korea ..... 96-35004

[51] Int. Cl.[6] ..... G03G 15/08

[52] U.S. Cl. ..... 399/283

[58] Field of Search ..... 399/273, 283

[56] References Cited

U.S. PATENT DOCUMENTS 3,918,808 11/1975 Narita ..... 399/149
4,989,037 1/1991 Nagatsuna ..... 399/167
5,057,871 10/1991 Hirose et al. ..... 399/283
5,223,668 6/1993 Takaya et al. ..... 399/283 X
5,317,370 5/1994 Kohyama et al. ..... 399/222
5,387,963 2/1995 Kajimoto et al. ..... 399/273 X
5,387,967 2/1995 Brewington et al. ..... 399/273 X
5,404,211 4/1995 Hashimoto et al. ..... 399/126
5,570,164 10/1996 Yamamoto et al. ..... 399/283

*Primary Examiner*—William Royer
*Attorney, Agent, or Firm*—Robert E. Bushnell, Esq.

[57] ABSTRACT

A developing unit for an electrophotographic apparatus that uses a cleaning roll, oppositely charged from the toner remaining on the developing roller, to clean a developing roller after a latent electrostatic image has been developed into a latent toner image. The ink is removed from the developing roller and mixed with fresh toner from the toner cartridge to maintain a uniform charge throughout the toner that is applied to the developing roller and to increase the quality of resolution obtained when printing for an extended period of time.

23 Claims, 4 Drawing Sheets

○ : TONER FED FROM THE TONER CARTRIDGE
● : TONER SUPPLIED BY THE TONER SUPPLY ROLLER
⊘ : TONER REGULATED BY THE DOCTOR-BLADE TO HAVE A UNIFORM THICKNESS
□ : TONER REMAINING AFTER DEVELOPING A LATENT TONER IMAGE ON THE PHOTOSENSITIVE DRUM
■ : TONER RECOVERED BY THE CLEANING ROLLER

TONER REMIXING DEVELOPING UNIT

CLAIM OF PRIORITY

This application makes reference to, incorporates the same herein, and claims all rights accruing thereto under 35 U.S.C. §119 through my patent application entitled Developing Unit of an Electrophotographic Apparatus earlier filed in the Korean Industrial Property Office on the Oct. 22, 1996 and there duly assigned Serial No. 1996/35004.

BACKGROUND OF THE INVENTION

1. Field of the Invention

The present invention relates to a device for an electrophotographic apparatus and, more particularly, to a device for improving the quality of ink supplied to the photoconductive drum in an electrophotographic apparatus.

2. Background Art

Supplying a consistently high quality of toner to a photoconductive drum is crucial for the proper operation of an electrophotographic apparatus during the printing process. An electrophotographic apparatus can be either one of a laser printer, an electronic copier, a facsimile machine, or any versatile office machine. The general operation of an electrophotographic apparatus starts with paper being loaded from a supply tray and then transported through to a high pressure transfer roller. The high pressure transfer roller transfers the toner image from the photoconductive drum onto the sheet of paper. Subsequently, the paper is transported to a fixing device that fuses the toner image onto the paper using both heat and pressure rollers.

To prepare the toner image for the high pressure transfer roller, it is necessary to attach toner particles to the latent electrostatic image on the photoconductive drum. The toner particles are applied by the developing unit and transform the latent electrostatic image into a latent toner image.

A toner cartridge charged with a static voltage is contained in the developing unit and supplies toner to the supply roller. The toner is stirred by an agitator that keeps the toner evenly charged and mixed. The electrostatically charged toner is transferred to the supply roller by the rotation of the agitator. The rotation of the supply roller then transfers the toner to a developing roller. The toner deposited on the developing roller is uniformly applied due to a doctor-blade that maintains a constant level of thickness of toner on the developing roller.

A photoconductive drum is charged by a charger roller with a static negative voltage. Then, the photoconductive drum is rotated and exposed to the light from a light emitting device. The parts of the photoconductive drum surface exposed to the light generate an latent electrostatic image. This latent electrostatic image is transformed into a latent toner image when toner particles are attached to the latent electrostatic image by the developing roller. A sheet of paper loaded from a paper tray is fed into the electrophotographic apparatus by a pickup roller. The paper is then transferred to a high pressure transfer roller that presses the paper against the photoconductive drum to transfer the toner image onto the sheet of paper from the drum. Then the paper, and applied toner image, is transported between the heating roller and the pressure roller of a fixing unit to fuse the toner image into the sheet using both heat and pressure.

More specifically, the developing roller is mounted between the photoconductive drum and the toner supply roller. Toner is stirred by the agitator and fed to the developing roller. A doctor-blade contacts the developing roller and controls the thickness of the toner applied to the developing roller. Then, the photoconductive drum rotates and brings the latent electrostatic image into contact with the layer of toner formed on the developing roller, thus developing a latent toner image. After developing the latent toner image, the toner that remains on the developing roller is partially recovered and mixed with the reservoir of ink supplied by the toner cartridge while most of the remaining toner stays attached to the surface of the developing roller. This re-using of toner can lower the quality of printed images.

Different innovations have been developed to regulate the toner used in an electrophotographic apparatus. By way of example, U.S. Pat. No. 5,317,370 to Kohyama entitled Developing Apparatus Including Means for Collecting Used Developing Agent, shows the removal of used toner from the toner supply roll. Both U.S. Pat. No. 4,989,037 to Nagatsuna entitled Device for Driving a Rotary Body and U.S. Pat. No. 3,918,808 to Narita entitled Photorecptor Cleaning Device for Electrophotographic Copying Apparatus of the Dry Cleaning Agent Type, mention devices for cleaning excess toner from a photoconductive drum.

I have observed that what is needed, but has so far been neglected in the art, is a developing unit that removes the toner remaining on the developing roller after the developing process is finished. This will avoid continuously stressing the re-used toner with pressures applied between the photoconductive drum and the developing roller and with the pressures applied between the developing roller and the doctor-blade. Thus, the degradation of printing quality, especially when a great number of sheets are being printed or after a long time has passed without operating the electrophotographic apparatus, can be eliminated. I believe that this inadvertent re-using of toner also causes the toner on the developing roller to have a non-uniform electrical charge. Consequently, images printed under some circumstances lack the high resolution otherwise possible. I expect that a developing roller that does not re-use toner that has been on the developing roller during a development process will improve the resolution of printed images and the usefulness of the associated electrophotographic apparatus.

SUMMARY OF THE INVENTION

Accordingly, it is an object of the present invention to provide an improved developing unit for an electrophotographic apparatus.

It is another object to provide a developing unit that can remove the toner that remains on the developing roller after a latent toner image is developed.

It is still another object to provide a developing unit that can print images having a high resolution.

It is yet another object to provide a developing unit that mixes the toner that remains on the developing roll after developing a latent toner image with fresh toner.

It is still yet another object to provide a developing unit that maintains a uniform electrostatic potential throughout the toner on the developing roll.

It is a further object of the present invention to provide a developing unit that can reduce the degradation of print quality after long term operation of the electrostatic apparatus.

To achieve these and other objects, a developing unit for an electrophotographic apparatus may be constructed with a developing roller, a toner supply roller, a doctor-blade, and a cleaning roller that removes the toner that remains on the developing roller after developing the latent toner image. A cleaning voltage charger may also be used to charge the cleaner roll with a static electricity of the opposite polarity from that of the toner remaining on the developing roll. Thus, the remaining toner is attracted by the cleaning roller and removed from the developing roller.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
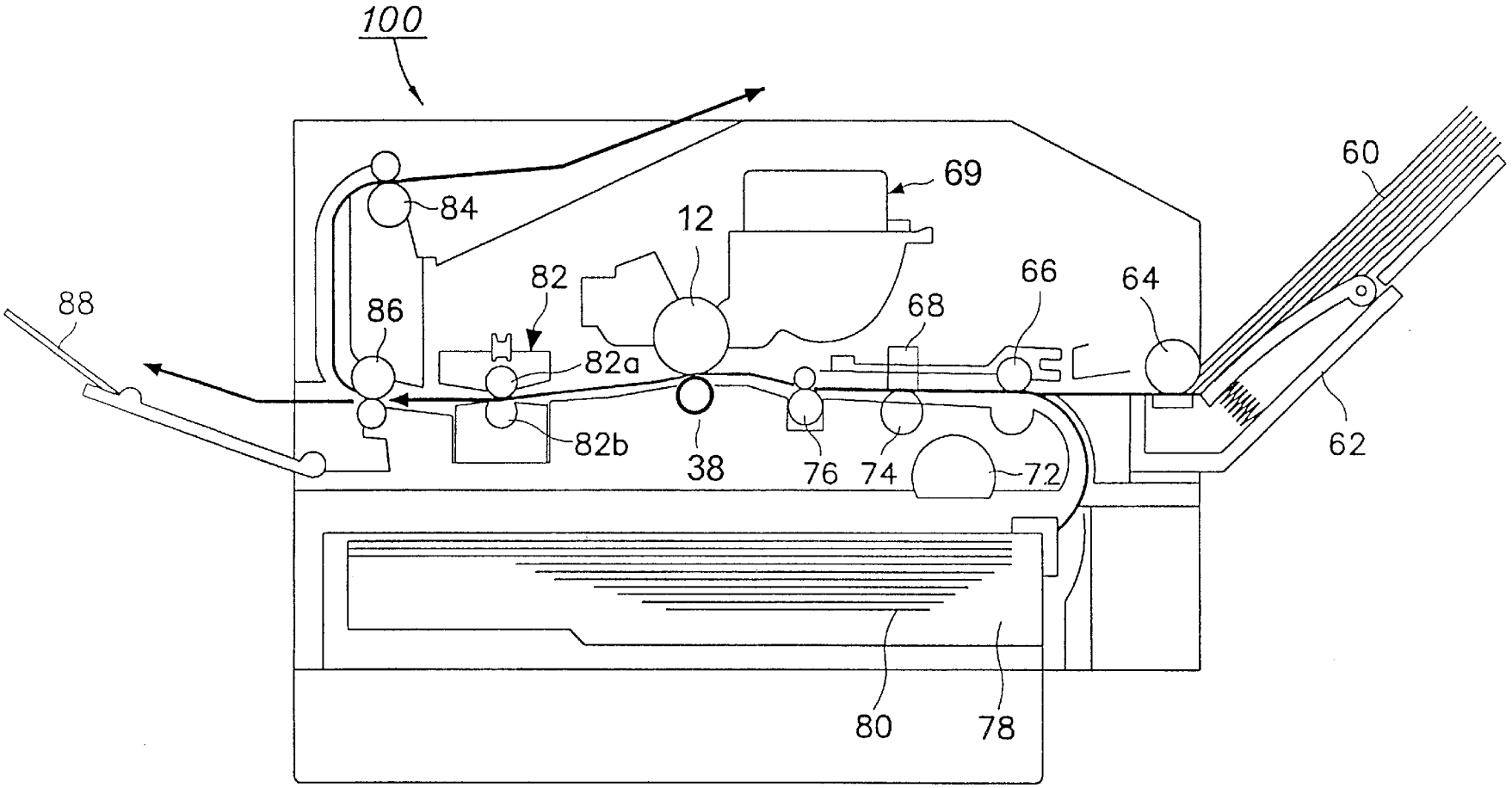
FIG. 1 is a schematic diagram of the general structure of an electrophotographic apparatus.

Turning now to the drawings, particularly FIG. 1, which illustrates the operation of a versatile office machine 100. A sheet of paper 60 is loaded from document tray 62 and transported to a contact image sensor (CIS) 68, by automatic document supplying roller 64 and transfer roller 66. Then, CIS 68 generates a light beam to scan sheet of paper 60. The light beam passes through the document reflected by white roller 74. The reflected light beam is detected by an optical sensor that translates the corresponding image into computer readable binary information. Subsequently, paper 60 is transported by transfer roller 76 and passes by photoconductive drum 12 and is then fixed by a fixing unit. Then, pickup roller 86 and discharging roller 84 eject paper 88. Alternatively, paper 80 can be fed from cassette 78 by roller 72.

During the beginning of a printing operation the surface of photoconductive drum 12 is uniformly charged by a charging unit provided in versatile office machine 100. Then, the surface of photoconductive drum 12 is exposed to light produced by an exposing unit, thus forming a latent electrostatic image. The electrostatic image is then transformed to a latent toner image by fine tone particles that are attached by developing unit 69. The toner image formed on photoconductive drum 12 is transferred to the paper by high pressure transfer roller 38. The toner image is fused onto paper 60 at fixing unit 82 by heating roller 82*a* and pressure roller 82*b*. Then, the sheet 60 is discharged by discharging roller 84 and ejected from the electrophotographic machine.

Figure 2:
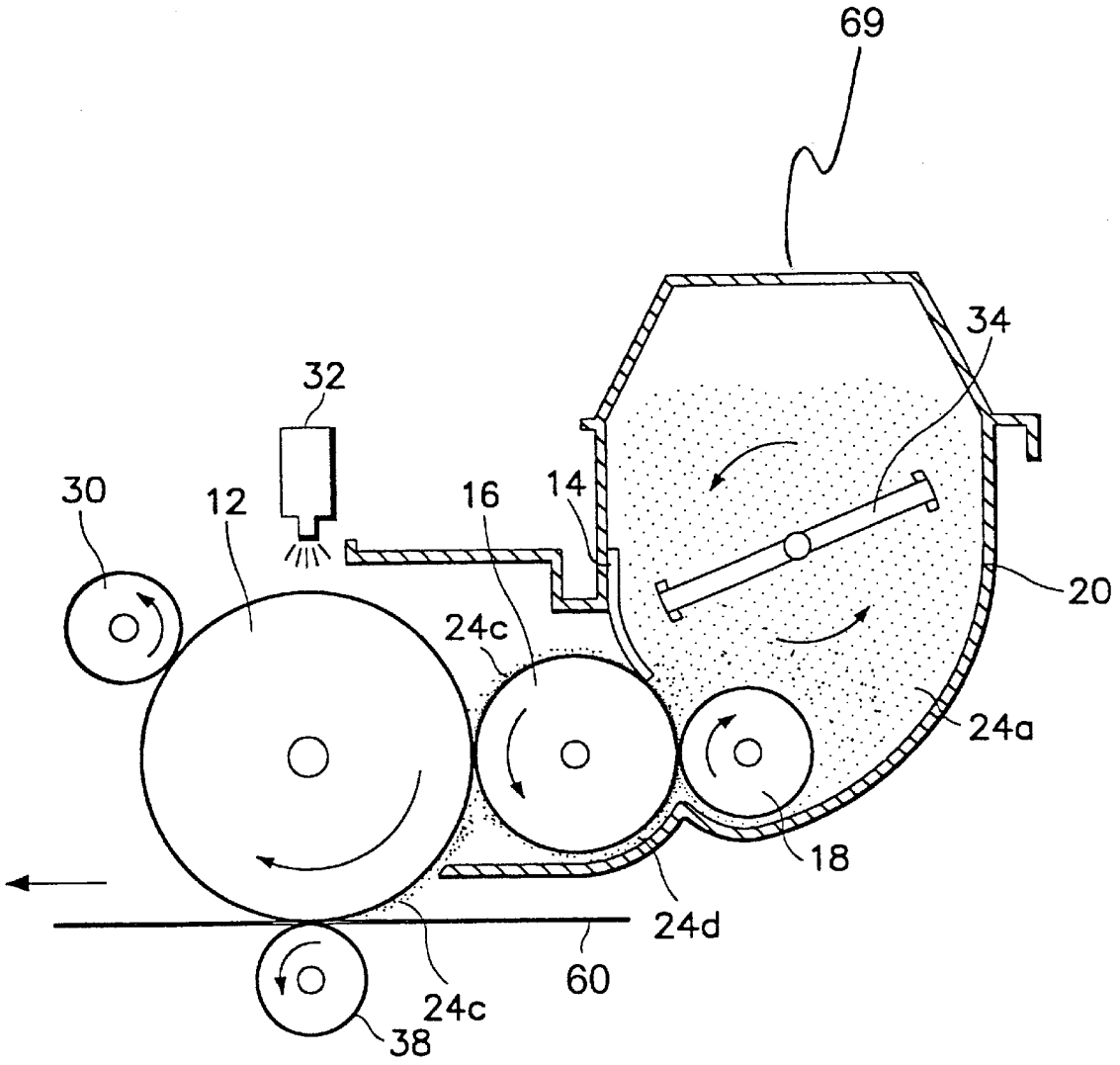
FIG. 2 is a schematic diagram of the general structure of a few essential components of an electrophotographic apparatus.

As shown in FIG. 2, a toner cartridge 7 or reservoir, 20 charged with a static voltage is contained in the developing unit and supplies toner to the supply roller. The toner is stirred by agitator 34 to keep the toner evenly charged and mixed. The electrostatically charged toner 24*a* is transferred to the supply roller by the rotation of agitator 34. The rotation of supply roller 18 then transfers toner 24*a* to developing roller 16. The toner 24*c* deposited on developing roller 16 is uniformly applied due to doctor-blade 14 that maintains a constant toner thickness on the developing roller.

Photoconductive drum 12 is charged by charger roller 30 with a static negative voltage. Then, the photoconductive drum is rotated and exposed to light emitting device 32. The parts of the photoconductive drum surface exposed to light generate a latent electrostatic image. This latent electrostatic image is transformed into a latent toner image when toner particles are attached to the latent electrostatic image by developing roller 16. A sheet of paper 60 is loaded from a paper tray and is fed into the electrophotographic apparatus by a pickup roller. The paper is then transferred to high pressure transfer roller 38 that presses the paper against the photoconductive drum to transfer the toner image onto the sheet of paper from the drum. Then the paper, and applied toner image, is transported between the heating roller and the pressure roller of a fixing unit to fuse the toner image into the sheet using both heat and pressure.

Figure 3:
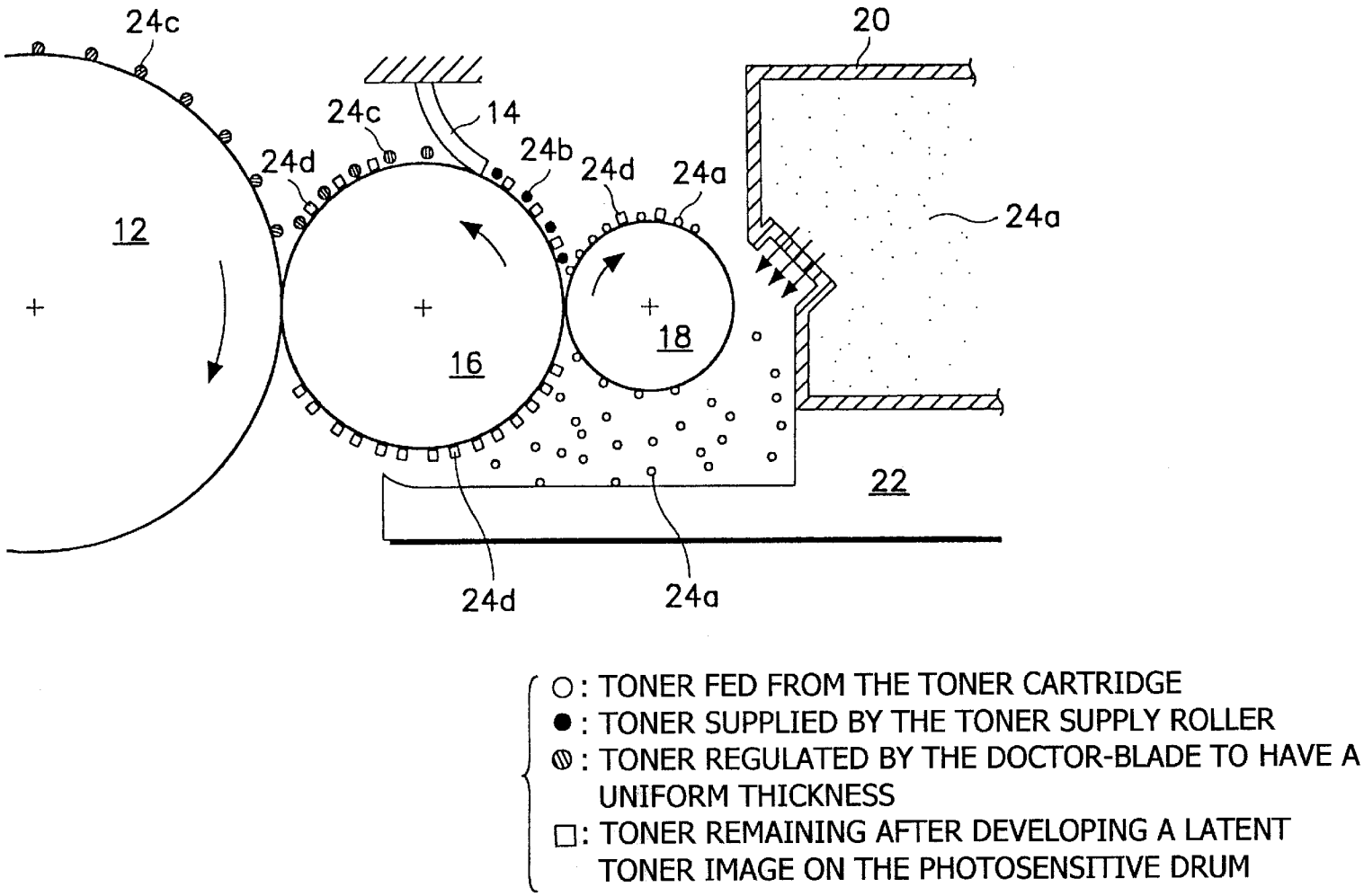
FIG. 3 is a schematic diagram of a developing unit used in an electrophotographic apparatus.

More specifically, as shown in FIG. 3, developing roller 16 is mounted between photoconductive drum 12 and toner supply roller 18. Toner 24*a* is stored in reservoir 20, stirred by agitator 34 and fed to the developing roller. Doctor-blade 14 contacts developing roller 16 and controls the thickness of toner 24*b* applied to the developing roller. Then, photoconductive drum 12 rotates and brings the latent electrostatic image into contact with the layer of toner 24*c* formed on developing roller 16, thus developing the latent toner image. After developing the latent toner image, the toner that remains on developing roller 16 is partially recovered and mixed with the reservoir of ink supplied by the toner cartridge while most of remaining toner 24*d* stays attached to the surface of developing roller 16. Lower frame 22 is part of the developer frame of the present invention.

Figure 4:
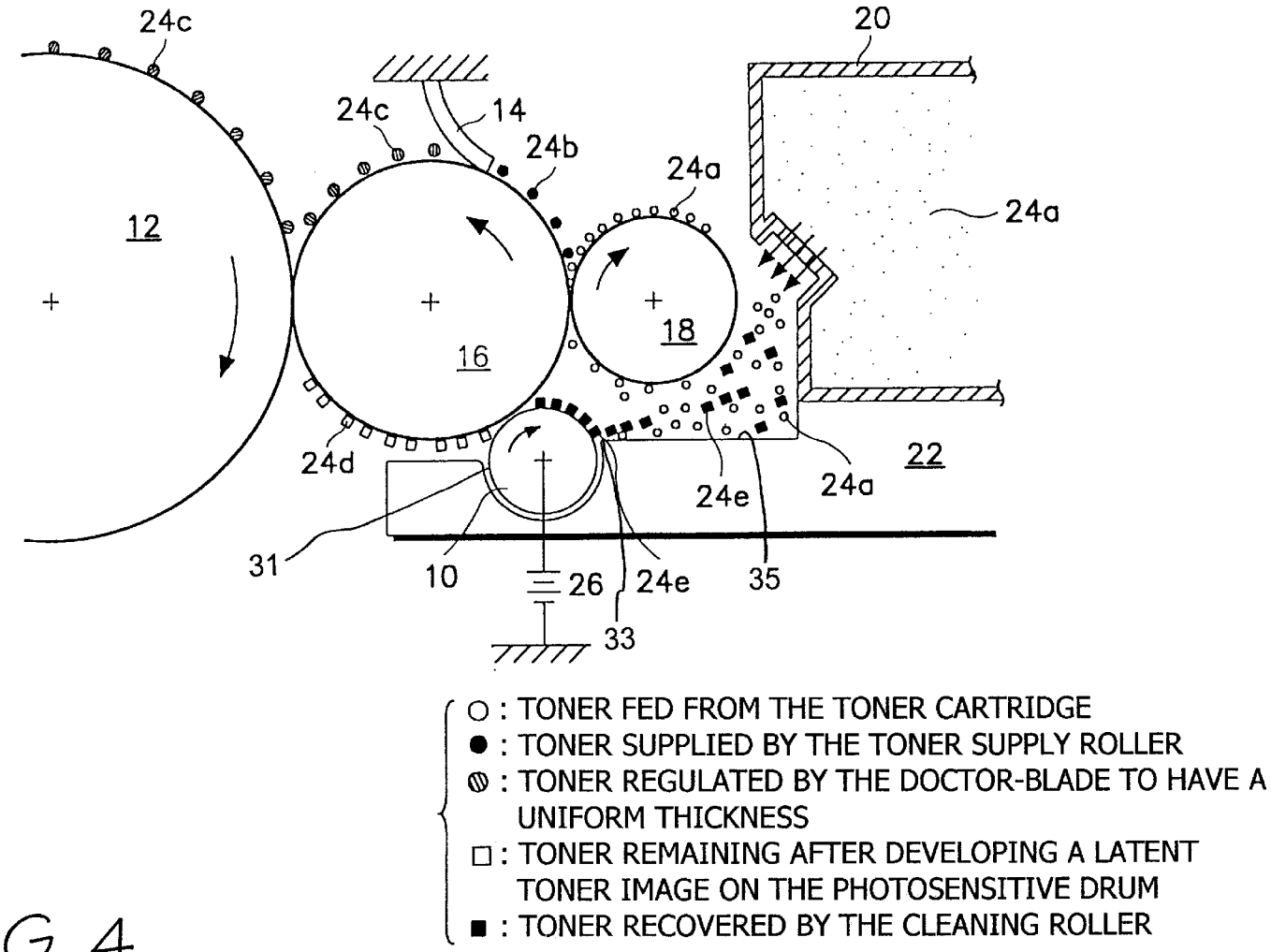
FIG. 4 is a schematic diagram of a developing unit as constructed according to the principles of the present invention with a cleaning roller for removing the toner that remains on the developing roller after the development of the latent toner image.

FIG. 4 illustrates a developing unit as constructed according to the principles of the current invention. Developing roller 16 is positioned adjacent to photoconductive drum 12 to apply the negatively charged toner particles 24*c* necessary to develop the latent electrostatic image into a latent toner image. Toner supply roller 18 feeds toner, from reservoir 20, that has been stirred by agitator 34, to developing roller 16. Doctor-blade 14 is positioned to contact developing roller 16 and to regulate the thickness of toner 24*b* applied to the developing roller.

A cleaning roller 10 is positioned in a groove 33 in lower frame 22 to contact the bottom of developing roller 16. Pressure from the cleaning roller combined with its opposite charge from the toner combine to remove the toner that remains on the developing roller. Cleaning voltage charger 26 applies a positive electrostatic voltage to cleaning roller 10 to attract negatively charged toner particles 24*d* that remain on the developing roller after a latent toner image has been developed. Cleaner roller 10 is mounted within groove 31 formed at a corner 33 of surface 35 of frame 22. The simplicity of using corner 33 eliminates the need for extra components.

During the operation of the electrophotographic apparatus, toner 24*a* is transported by the rotation of toner supply roller 18 to developing roller 16, where toner 24*b* is deposited with a uniform thickness due to the regulation of doctor-blade 14. Photoconductive drum 12 is rotated clockwise to contact the latent electrostatic image with the toner layer 24*c* on the developing roller 16. This causes the latent electrostatic image to be transformed into a latent toner image.

Then, the toner 24*d* remaining on developing roller 16 is removed by cleaning roller 10 and mixed with fresh toner 24*a*, as shown in FIG. 4. The toner obtained by mixing fresh toner 24*a* and remaining toner 24*d* is then fed to the developing roller by toner supply roller 18.

Thus, the inventive developing unit uses a cleaning roller to remove remaining toner from the developing roller after the developing process. This causes the developing roller to always receive fresh uniformly charged toner. Hence, the difficulties caused by continuously stressing the remaining toner on the developing roller are eliminated along with the concurrent degradation of print quality. This increases the resolution and quality of printed images that can be obtained when printing for an extended period of time.

Although this preferred embodiment of the present invention has been disclosed for illustrative purposes, those skilled in the art will appreciate that various modifications, additions and substitutions are possible, without departing from the scope and spirit of the invention as disclosed in the accompanying claims. It is also possible that other benefits or uses of the currently disclosed invention will become apparent over time.

What is claimed is:

1. A developing unit for an electrophotographic apparatus, comprising:

a frame;

a reservoir inside said frame containing a plurality of toner;

a toner supply roller rotatably attached to said frame for collecting said toner that is emitted from said reservoir;

a mixing area in said developing unit positioned between said reservoir and said toner supply roller;

a developing roller rotatably attached to said frame and having a layer of said toner on an outer surface before developing a latent image;

a cleaning roller rotatably attached to said frame adjacent to said developing roller, said cleaning roller oppositely charged from and removing said toner remaining on said developing roller after the development of said latent image; and said frame bearing a groove accommodating rotation of said cleaning roller against an edge of said frame in proximate contact with said cleaning roller with said toner on said cleaning roller being separated from said cleaning roller and propelled into said mixing area.

2. The developing unit for an electrophotographic apparatus of claim 1, further comprising:

said toner supply roller transferring said toner to said developing roller;

an agitator in said reservoir mixing said toner and transferring said toner to said toner supply roller;

a doctor-blade contacting said developing roller and maintaining a constant thickness of said toner on said developing roller; and a cleaning voltage charger supplying a voltage to said cleaning roller.

3. The developing unit for an electrophotographic apparatus of claim 1, further comprising:

said developing unit having a body comprising a first portion and a second portion;

said developing roller rotatably fixed between said first portion and said second portion;

said cleaning roller partially recessed into said first portion and rotatably fixed;

a doctor-blade attached to said second portion and contacting said developing roller; and said toner supply roller rotatably fixed adjacent to said developing roller and between said first portion and said second portion.

4. The developing unit for an electrophotographic apparatus of claim 1, further comprised of said cleaning roller exerting a constant force against said developing roller.

5. The developing unit for an electrophotographic apparatus of claim 1, further comprised of said cleaning roller rotating in a direction opposite to said developing roller.

6. The developing unit for an electrophotographic apparatus of claim 1, further comprised of said toner supply roller positioned to allow said toner leaving said cleaning roller to mix with a plurality of fresh toner before said toner supply roller applies said toner to said developing roller.

7. A developing unit for an electrophotographic apparatus, comprising:

a frame having a groove;

a reservoir inside said frame containing a plurality of toner;

a toner supply roller rotatably attached to said frame for collecting said toner that is emitted from said reservoir;

said frame defining a channel disposed between said reservoir and said toner supply roller, said channel providing a mixing area for said toner;

a developing roller rotatably attached to said frame and having a layer of said toner on an outer surface before developing a latent image;

a cleaning roller rotatably attached to said frame partially recessed into said groove and rotatably fixed adjacent to said developing roller, said cleaning roller oppositely charged from and removing said toner remaining on said developing roller after the development of said latent image; and said frame bearing said groove accommodating rotation of said cleaning roller against an edge of said frame in proximate contact with said cleaning roller with said toner on said cleaning roller being separated from said cleaning roller and propelled into said mixing area.

8. The developing unit for an electrophotographic apparatus of claim 7, further comprising:

said toner supply roller transferring said toner to said developing roller;

an agitator in said toner cartridge mixing said toner and transferring said toner to said toner supply roller via said mixing area;

a doctor-blade attached to said frame and contacting said developing roller and maintaining a constant thickness of said toner on said developing roller; and a cleaning voltage charger supplying a voltage to said cleaning roller.

9. The developing unit for an electrophotographic apparatus of claim 7, further comprised of a photoconductive drum receiving toner from said developing roller to produce a toner image from a latent image.

10. The developing unit for an electrophotographic apparatus of claim 7, further comprised of said cleaning roller exerting a constant force against said developing roller.

11. The developing unit for an electrophotographic apparatus of claim 7, further comprised of said cleaning roller rotating in a direction opposite to said developing roller.

12. The developing unit for an electrophotographic apparatus of claim 7, further comprised of said toner supply roller positioned to allow said toner leaving said cleaning roller to mix with a plurality of fresh toner before said toner supply roller applies said toner to said developing roller.

13. The developing unit for an electrophotographic apparatus of claim 7, further comprised of said electrophotographic apparatus removing toner from said developing roller and mixing said toner with fresh toner from said reservoir prior to the use of said toner and said fresh toner by said supply roller.

14. A developing unit for an electrophotographic apparatus, comprising:

a frame having a groove;

a reservoir inside said frame containing a plurality of toner;

a toner supply roller rotatably attached to said frame for transporting said toner that is emitted from said reservoir;

said frame defining a channel disposed between said reservoir and said toner supply roller, said channel providing a mixing area for said toner;

a developing roller rotatably attached to said frame and having a layer of said toner on an outer surface before developing a latent image;

said toner supply roller transferring said toner to said developing roller;

a cleaning roller rotatably attached to said frame and partially recessed into said groove adjacent to said developing roller, said cleaning roller oppositely charged from and removing said toner remaining on said developing roller after the development of said latent image;

a cleaning voltage charger supplying a voltage to said cleaning roller; and said frame bearing said groove accommodating rotation of said cleaning roller against an edge of said frame in proximate contact with said cleaning roller with said toner on said cleaning roller being separated from said cleaning roller and propelled into said mixing area.

15. The developing unit for an electrophotographic apparatus of claim 14, further comprising:

an agitator in said reservoir mixing said toner and transferring said toner to said toner supply roller; and a doctor-blade attached to said frame and contacting said developing roller and maintaining a constant thickness of said toner on said developing roller.

16. The developing unit for an electrophotographic apparatus of claim 14, further comprised of said toner supply roller rotatably fixed adjacent to said developing roller.

17. The developing unit for an electrophotographic apparatus of claim 14, further comprised of said cleaning roller exerting a constant force against said developing roller.

18. The developing unit for an electrophotographic apparatus of claim 14, further comprised of said cleaning roller rotating in a direction opposite to said developing roller.

19. The developing unit for an electrophotographic apparatus of claim 14, further comprised of said toner supply roller positioned to allow said toner leaving said cleaning roller to mix with a plurality of fresh toner before said toner supply roller applies said toner to said developing roller.

20. The developing unit for an electrophotographic apparatus of claim 14, further comprised of said electrophotographic apparatus removing toner from said developing roller and mixing said toner with fresh toner from said reservoir prior to the use of said toner and said fresh toner by said supply roller.

21. The developing unit for an electrophotographic apparatus of claim 14, wherein said cleaning roll, said rib, and said reservoir are positioned so that said toner recovered by said cleaning roller is propelled in a substantially opposite direction from a plurality of fresh toner emitted by said reservoir.

22. The developing unit for an electrophotographic apparatus of claim 7, wherein said cleaning roll, said rib, and said reservoir are positioned so that said toner recovered by said cleaning roller is propelled in a substantially opposite direction from a plurality of fresh toner emitted by said reservoir.

23. The developing unit for an electrophotographic apparatus of claim 1, wherein said cleaning roll, said rib, and said reservoir are positioned so that said toner recovered by said cleaning roller is propelled in a substantially opposite direction from a plurality of fresh toner emitted by said reservoir.

* * * * *